US005313708A

United States Patent [19]

Edwards et al.

[11] Patent Number: 5,313,708

[45] Date of Patent: May 24, 1994

[54] CAN OPENER

[75] Inventors: Billie R. Edwards, Deepwater; Mary K. Barrow, Clinton, both of Mo.

[73] Assignee: The Rival Company, Kansas City, Mo.

[21] Appl. No.: 986,123

[22] Filed: Dec. 4, 1992

[51] Int. Cl.[5] ..... B67B 7/00

[52] U.S. Cl. ..... 30/417; 30/423; 30/424; 30/426

[58] Field of Search ..... 30/417, 418, 419, 420, 30/421, 422, 423, 424, 425, 426, 427, 401

[56] References Cited

U.S. PATENT DOCUMENTS

| | | | |
|---|---|---|---|
| D. 276,406 | 11/1984 | Johnson et al. . | |
| 2,204,368 | 6/1940 | Kublin . | |
| 2,896,319 | 7/1959 | Pinette . | |
| 2,979,815 | 4/1961 | Rohde et al. . | |
| 2,997,785 | 8/1961 | Pinette . | |
| 3,079,683 | 3/1963 | Carew et al. . | |
| 3,105,297 | 10/1963 | Clowers . | |
| 3,156,044 | 11/1964 | Congdon et al. . | |
| 3,176,063 | 3/1965 | Jepson et al. . | |
| 3,216,108 | 11/1965 | Jepson et al. . | |
| 3,254,406 | 6/1966 | Hubrich . | |
| 3,307,255 | 3/1967 | Hubrich . | |
| 3,313,023 | 4/1967 | Jepson et al. . | |
| 3,348,305 | 10/1967 | Bielak . | |
| 3,360,853 | 1/1968 | Chambers et al. . | |
| 3,376,671 | 4/1968 | Wolter . | |
| 3,477,263 | 11/1969 | Jepson et al. . | |
| 3,520,056 | 7/1970 | Scott . | |
| 3,585,717 | 6/1971 | Bielak et al. . | |
| 3,673,682 | 7/1972 | Yamamoto . | |
| 3,675,321 | 7/1972 | Arel et al. . | |
| 3,689,997 | 9/1972 | McLean | 30/424 |
| 3,706,135 | 12/1972 | Fukunaga et al. . | |
| 3,765,085 | 10/1973 | Ponczek et al. . | |
| 3,805,380 | 4/1974 | Yamamoto | 30/417 |
| 3,858,313 | 1/1975 | Yamaguchi . | |
| 3,881,247 | 5/1975 | Niwa | 30/417 |
| 3,911,571 | 10/1975 | Ponczek et al. . | |
| 3,942,247 | 3/1976 | Ponczek et al. . | |
| 3,949,468 | 4/1976 | McLean et al. | 30/424 |
| 3,955,276 | 5/1976 | Pauty . | |
| 4,028,805 | 6/1977 | Figlia | 30/423 |
| 4,053,981 | 10/1979 | Aberer | 30/426 |
| 4,207,676 | 6/1980 | Okumura . | |
| 4,534,108 | 8/1985 | Yamamoto et al. . | |
| 4,561,182 | 12/1985 | Yamamoto et al. . | |
| 4,733,472 | 3/1988 | Belcourt . | |
| 4,831,735 | 5/1989 | Bast et al. . | |
| 4,922,617 | 5/1990 | Kurz . | |
| 4,995,164 | 2/1991 | Borger et al. . | |

FOREIGN PATENT DOCUMENTS

| | | |
|---|---|---|
| 3048063 | 7/1982 | Fed. Rep. of Germany . |

*Primary Examiner*—Richard K. Seidel
*Assistant Examiner*—Paul M. Heyrana, Sr.
*Attorney, Agent, or Firm*—Willian Brinks Hofer Gilson & Lione

[57] ABSTRACT

A can opener of the type having a housing, a motor, a feed wheel for rotating a can about its axis, a gear assembly connecting the motor and the feed wheel, and a cutter for severing a can lid from a can includes a cutter control associatively connected to the cutter and operable to bias a switch contact to a closed position while the cutter is severing the can lid from the can and to automatically open the switch contact after the can lid has been severed, the cutter control comprising an integrally formed spring operable to engage an armature mounted on the housing, and a cutter support plate supporting the cutter and associatively connected to the cutter control, the cutter support plate operable to lower a magnet assembly into contact with the can lid when the cutter is moved into contact with the can lid and to raise the magnet assembly and the can lid when the cutter is raised from the can after the can lid has been severed from the can.

21 Claims, 5 Drawing Sheets

CAN OPENER

BACKGROUND OF THE INVENTION

The present invention relates to the field of can openers and, more particularly, to improvements therefor.

The first motorized can openers typically required an operator to depress and hold a cutter blade, via an operating lever, to pierce the can lid and to activate the can opener motor to start the cutting operation. After the can lid was severed from the can, the cutter blade had to be raised from the can to deactivate the can opener motor. Since the operation of this type of can opener depended upon the physical strength and exertion of the user, many people, especially the elderly, desired a can opener which would cause the cutter blade to pierce and sever the can lid without the user having to pierce the can lid and, further, which would automatically shut off after the can lid had been severed from the can.

Automatic can openers of the type described directly above have been available for a number of years. As described in U.S. Pat. No. 3,675,321, automatic can openers typically do not require the can lid to be pierced by the cutter blade to close a motor switch and thereby activate the motor to start the cutting operation. Rather, the motor switch is closed, and the motor activated, when the cutter blade comes into contact with the can lid. The cutter blade is usually oriented in such a way that the rotation of the can forces the cutter blade to pierce the can lid. A cutter control mechanism is operatively associated with the cutter blade such that the force developed between the cutter blade and the can lid as the cutting operation occurs causes the cutter control mechanism to maintain the switch in a closed position. After the lid is severed from the can, the force between the can lid and the cutter blade is reduced. This force reduction is sufficient to cause the cutter control mechanism to open the switch and shut off the motor.

Many prior art automatic can openers, however, require the use of relatively complicated and expensive cutter control mechanisms to provide an automatic shut-off feature. Often, cutter control mechanisms are subject to failures and may require frequent maintenance. Additionally, known can openers do not utilize a cam-operated magnet arm assembly for lifting a severed can lid from a can.

It is, therefore, an object of the present invention to provide an improved can opener which includes a relatively uncomplicated and inexpensive cutter control.

It is another object of the present invention to provide a cam-operated magnet assembly operative to lift a severed can lid from a can at the same time as the cutter blade is removed from the can.

Other objects and advantages of the present invention will become apparent during the following detailed description, taken in conjunction with the accompanying drawings.

SUMMARY OF THE INVENTION

According to a first aspect of the present invention, a can opener of the type having a housing, a motor, a feed wheel for rotating a can about its axis, a gear assembly connecting the motor and the feed wheel, and a cutter for severing a can lid from a can includes the improvement comprising a cutter control associatively connected to the cutter and operable to bias a motor switch to a closed position while the cutter is severing the can lid from the can and to automatically open the motor switch after the can lid has been severed, the cutter control comprising an integrally formed spring operable to engage an armature mounted on the housing, and a cutter support plate supporting the cutter and associatively connected to the cutter control, the cutter support plate operable to lower a magnet assembly into contact with the can lid when the cutter is moved into contact with the can lid and to raise the magnet assembly and the can lid when the cutter is raised from the can after the can lid has been severed from the can.

According to a second aspect of the present invention, a can opener includes a cutter for severing a can lid from a can, an operating lever for lowering and raising the cutter and for opening and closing a can opener motor switch, and a linkage system connecting the operating lever to the cutter, the linkage system comprising a cutter control having integrally formed spring and biasing arms operable to engage an armature mounted on a can opener housing, the cutter control operative to maintain the operating lever in a position where the motor switch is closed while the can lid is being severed from the can by the cutter and to maintain the operating lever in a position where the motor switch is open when the cutter has severed the can lid from the can.

According to a third aspect of the present invention, a can opener includes a cutter mounted on a cutter support plate and operative to sever a can lid from a can, an operating lever associatively connected to the cutter support plate and operative to lower and raise the cutter and to open and close a can opener motor switch, and a magnet assembly pivotally mounted on the can opener and operatively associated with the cutter support plate, the cutter support plate operative to lower the magnet assembly into contact with the can lid when the operating lever is lowered to move the cutter into contact with the can lid and to raise the magnet assembly and the can lid when the operating lever is raised to remove the cutter from the can.

DETAILED DESCRIPTION OF THE PRESENTLY PREFERRED EMBODIMENT

Figure 1:
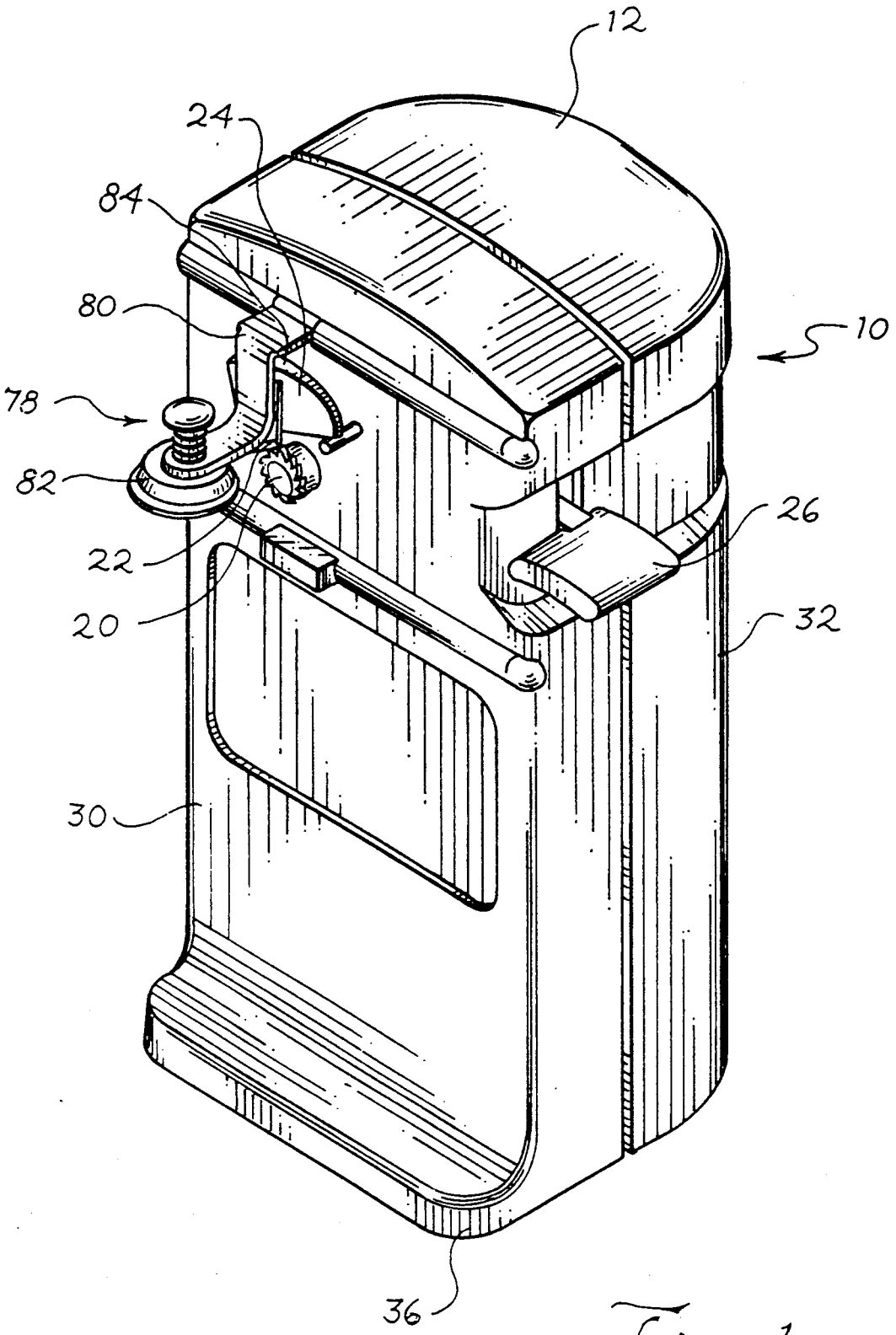
FIG. 1 is a perspective view of a can opener which incorporates a presently preferred embodiment of the present invention.

Referring now to the drawings, FIG. 1 shows a combined can opener and knife sharpener 10. The can opener 10 comprises a conventional housing 12 enclosing, among other things, a motor 14 which drives a feed wheel shaft 18 through a gear assembly 16. The feed wheel shaft 18 supports a serrated can feed wheel 20.

The can opener housing 12 comprises a front section 30 and a rear section 32. The sections 30, 32 are preferably joined by a screw 34, which connects the tops of the sections 30, 32, and mating tabs and slots (not shown) integrally formed on the bottoms of the rear section 32 and the front section 30, respectively. Alternately, the sections 30, 32 may be joined by any suitable means. The front section 30 generally supports the motor 14 and the gear assembly 16. Therefore, the front section 30 is formed with a forwardly projecting base 36 which operates to prevent the can opener 10 from tipping when a can 90 is received by the can opener 10.

The rear section 32 includes a rearwardly projecting portion 38 which carries a knife sharpening stone 40. The portion 38 includes a slot 42 for guiding a knife edge (not shown) into engagement with the sharpening stone 40.

As best shown in FIGS. 4, 5 and 6*a*–6*d*, the feed wheel 20 cooperates with a cutter 22 to open a can lid 92. The cutter 22 is attached to a cam-shaped support plate 24, whose function is described below. The cutter 22 is connected to an operating lever 26 by a linkage system 28. The linkage system 28 includes a lost-motion connector 44 and a spring cutter control 46. The cutter control 46 is connected to a shaft 48 which carries the cutter 22. The connector 44 is connected to the cutter control 46 at a first end 50 by means of a rivet 52. A second end 54 of the connector 44 contains a slot 56. A rivet 58 located on a leg portion 60 of the lever 26 rides within the slot 56. The lever 26 is pivotally connected to the front section 30 of the can opener housing 12 at Point A. The lever includes an extended leg 62 operative to engage a pair of switch contacts 64 when the lever 26 is depressed and a shoulder 66 positioned to engage a detent 68 placed on a spring-loaded plate 70 connected to the front section 30 of the can opener housing 12. The switch contacts 64 are connected to the motor 14 and an electrical cord 76 by means well known in the art. The detent 68 and the shoulder 66 cooperate to maintain the lever 26 in a non-operating position. Without the detent 68 and shoulder 66, the weight of the lever 26 may cause the lever 26 to lower and thereby activate the can opener 10.

The can opener 10 further includes a magnet assembly 78, which moves in coordination with the cutter 22. The magnet assembly 78 includes a generally L-shaped magnet lever arm 80 and a magnet 82 attached thereto. The magnet 82 operates to retain the lid 92 of a can 90 after the can lid 92 has been severed and the can 90 removed.

Figure 5:
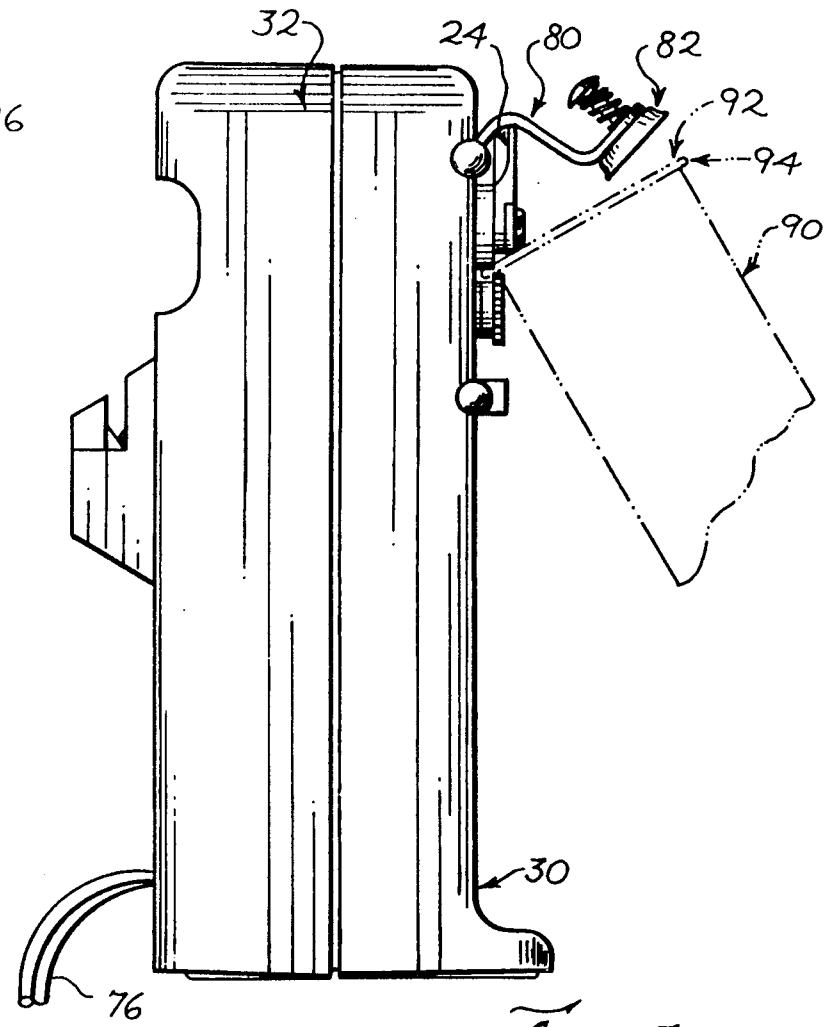
FIG. 5 is a side view of the can opener of FIG. 1 showing a can being loaded into the can opener.
Figure 2:
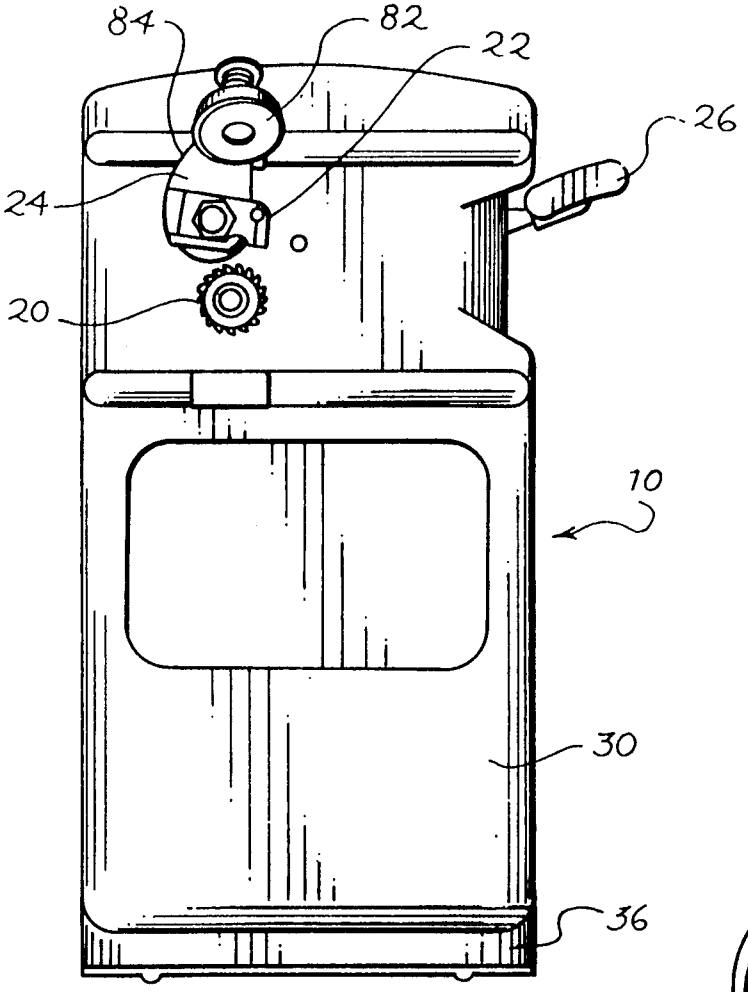
FIG. 2 is a front view of the can opener of FIG. 1.
Figure 4:
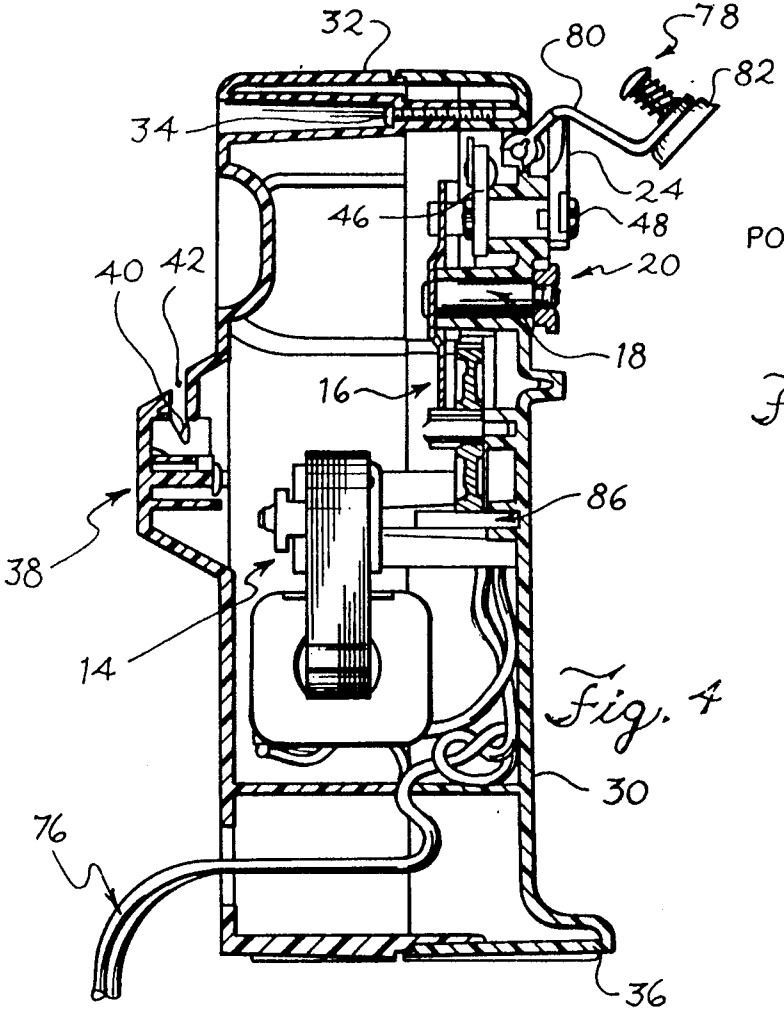
FIG. 4 is a cross-sectional view taken along line 4—4 of FIG. 3.

As best shown in FIGS. 1, 4 and 5, the magnet lever arm 80 is engaged by a cam portion 84 of the cam-shaped plate 24. As discussed more fully below, when the cutter 22, and thus the plate 24, is rotated into a cutting position with respect to a can, the magnet arm 80 rides along the cam portion 84 of the plate 24 such that the magnet assembly 78 is lowered. At this lowered position, the magnet 82 engages the lid 92 of the can 90 that is being opened. After the lid 92 is separated from the can 90, the cutter 22 and the plate 24 are rotated from the cutting position. During this rotation, the magnet arm 80 rides along the cam portion 84 until it reaches the position shown in FIGS. 2 and 4. At this position, the lid 92 is sufficiently removed from the can 90 to allow easy removal of the lid 92.

The cutter control 46 includes a spring arm 72 and a biasing arm 74. The spring arm 72 and the biasing arm 74 cooperate with an armature 29 extending downwardly from the top of the front section 30 to maintain the switch contacts 64 in a closed position when the can opener 10 is turned on, i.e., when the cutter 22 is rotated into a cutting position as described above, and to maintain the switch contacts 64 in an open position after the can lid 92 has been severed from the can 90 and the can 90 is being supported on the can opener 10 between the cutter 22 and the feed wheel 20.

Figure 6A:
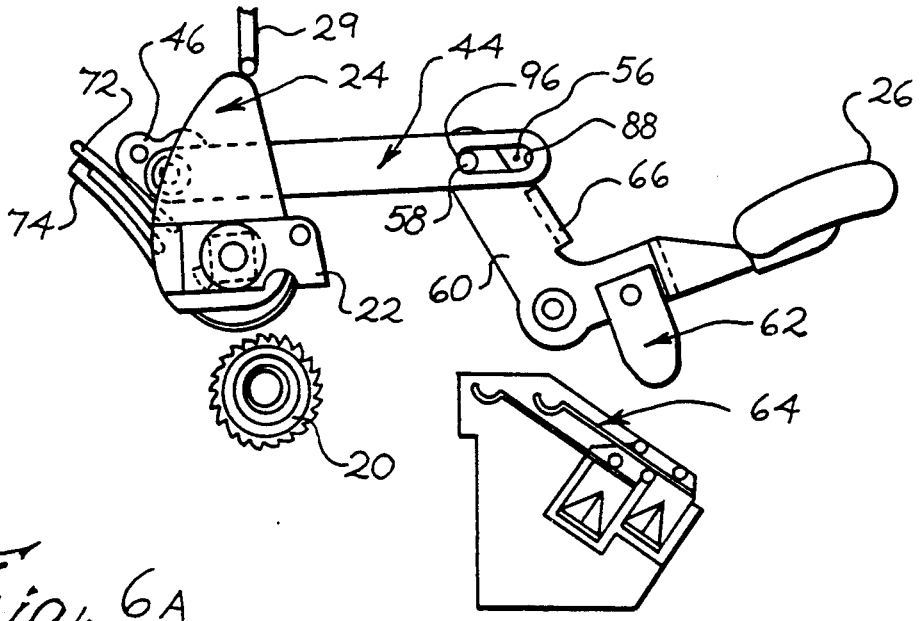
FIG. 6*a* is an enlarged schematic elevational view embodying a portion of FIG. 3 and illustrating a first operative position of the linkage system and the cutter in a retracted position for loading of the can.
Figure 6B:
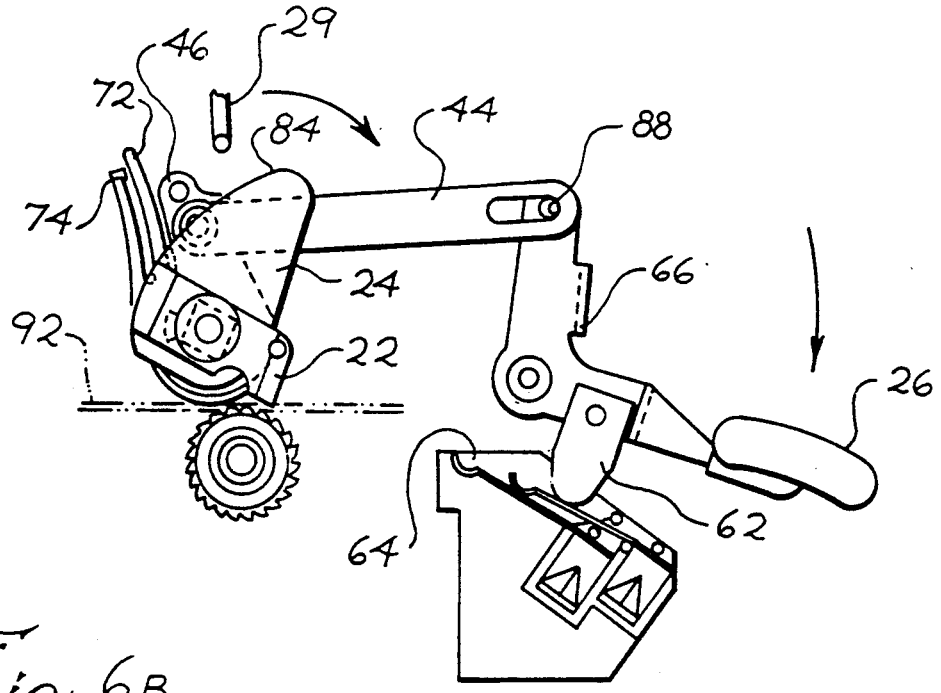
FIG. 6*b* is an enlarged schematic view similar to FIG. 6*a* illustrating the linkage system in a second operative position and the cutter ready to commence power piercing of the can lid.

Referring now to FIGS. 6*a*–6*d*, movement of the operating lever 26 from the position of 6*a* in a clockwise direction toward the position of FIG. 6*b* pivots the cutter control 46, via the connector 44, in a clockwise direction. As this occurs, the cutter 22 is moved into contact with the can lid 92 and the switch contacts 64 are closed, thereby activating the motor 14. To close the switch contacts 64, only approximately 1 pound of force must be applied to the operating lever 26. Rotation of the can 90 forces the cutter 22 from the position shown in FIG. 6*b* to the position shown in FIG. 6*c*. When this occurs, the reactive force developed between the can lid 92 as it is being cut and the cutter 22 further pivots the cutter control 46 in a clockwise direction. At the position shown in FIG. 6*c*, the cutter control 46 cooperates with the armature 29 and the connector 44 to maintain the switch contacts 64 in a closed position. Specifically, clockwise movement of the cutter control 46 from the position of FIG. 6*b* to the position of FIG. 6*c* forces the connector 44 to move to the right until the front edge 96 of the slot 56 engages the rivet 58 and thereby biases the operating lever 26 in a position where the switch contacts 64 are closed. In this position, the spring arm 72 presses against the armature 29 and the biasing arm 74 operates to support the spring arm 72. A reactive force (Arrow B in FIG. 6*c*) is developed between the armature 29 and the spring arm 72 of the cutter control 46 at this position. This reactive force opposes the clockwise movement of the cutter control 46. However, the force developed between the cutter 22 and the can lid 92 as the can lid 92 is being severed is greater than the force existing between the armature 29 and the spring arm 72. Therefore, the cutter control 46 is rotated to the position shown in FIG. 6*c*. As will described directly below, the reactive force (Arrow B) is utilized when the cutter 22 has completed severing the can lid 92.

After the can lid 92 has been severed from the can 90, the reactive force between the cutter 22 and the can lid 92 rapidly decreases. When this occurs, the cutter control 46 is no longer strongly biased in a clockwise direction, and the reactive force between the spring and biasing arms 72, 74 and the armature 29 forces the cutter control 46 slightly in a counterclockwise direction to the position shown in FIG. 6*d*. At this point, the cutter control 46 allows the operating lever 26 to raise to a position where the switch contacts 64 are opened and the motor 14 is deactivated.

It can thus be seen that the reactive force developed between the cutter 22 and the can lid 92 as the lid 92 is being severed cooperates with the cutter control 46 to maintain the switch contacts 64 in a closed position until the can lid 92 is completely severed from the can 90. When the can lid 92 is completely severed from the can 90, the reactive force disappears from the cutter control 46, thereby allowing the switch contacts 64 to open and automatically shut off the motor 14.

Figure 6C:
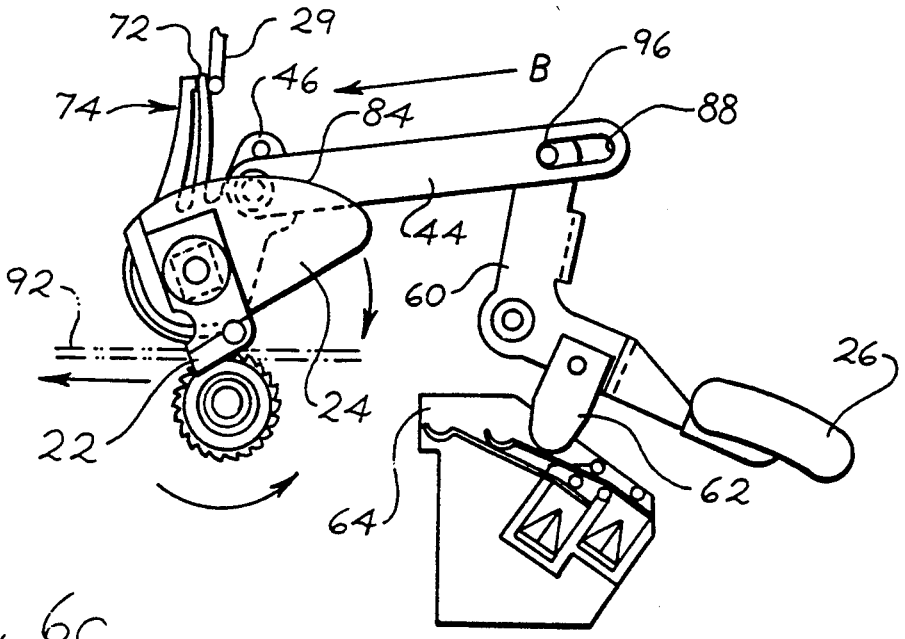
FIG. 6*c* is an enlarged schematic view similar to FIG. 6*b* illustrating the cutter in a cutting position.
Figure 6D:
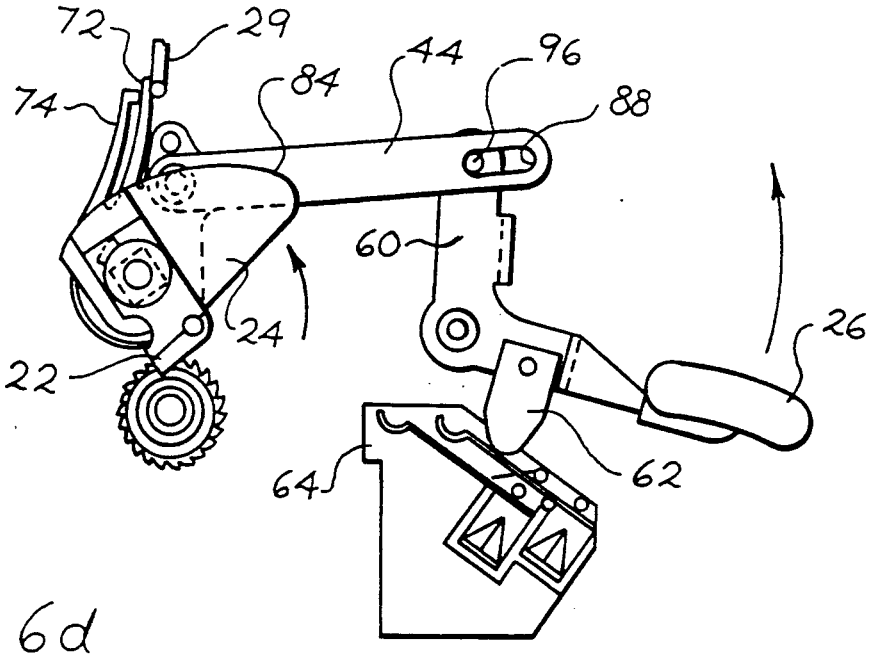
FIG. 6*d* is an enlarged schematic view similar to FIG. 6*c* illustrating the cutter in a can-supporting position after the can lid has been severed from the can.

Movement of the cutter 22 from the position of FIG. 6*c* to the position of FIG. 6*d* does not release the can 90 from the can opener 10. At the position shown in FIG. 6*d*, the can 90 is pressed between the cutter 22 and the feed wheel 20. Thus, the can 90 will be supported on the can opener 10 until the cutter 22 is removed from the can 90.

Figure 3:
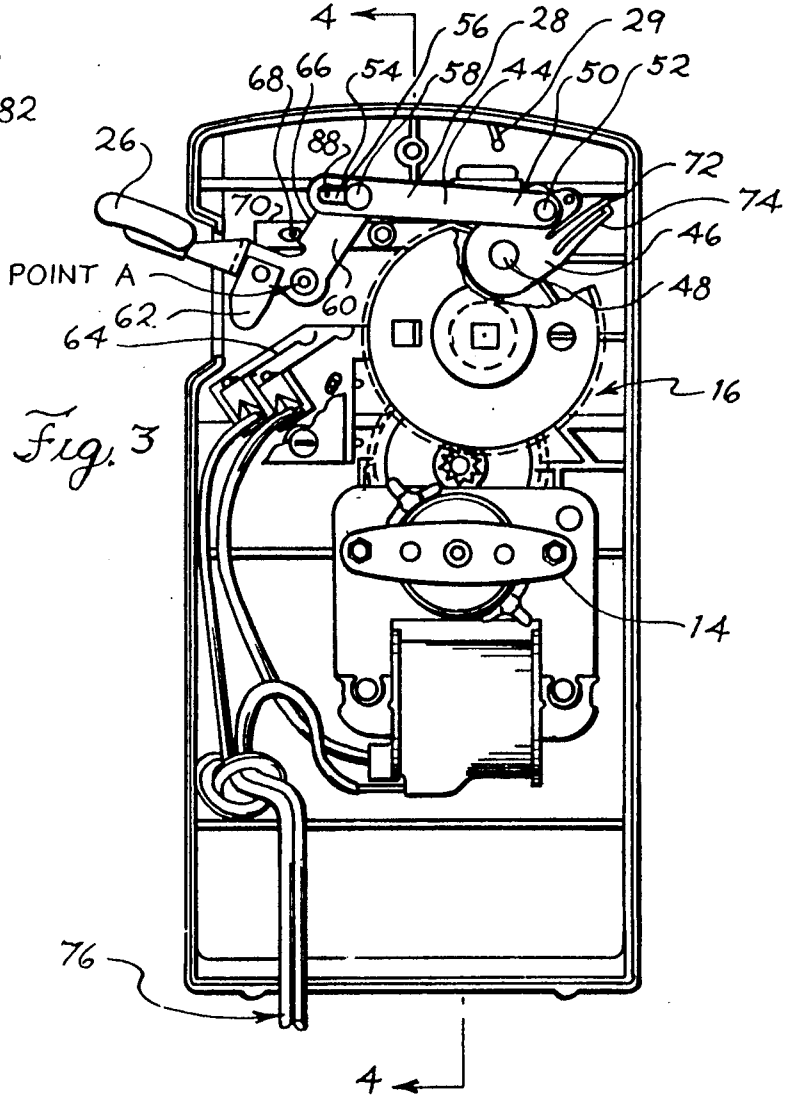
FIG. 3 is a rear view of the can opener shown in FIG. 1 with the rear section of the can opener housing removed.

The operation of the can opener 10 will now be described. A can 90 is placed alongside the can opener 10 such that the can rim 94 engages the feed wheel 20. The lever 26 is depressed, causing the extended leg 62 to engage the switch contacts 64 which, thereby, activate the motor 14. The motor 14 turns a drive shaft 86 which, through the gear assembly 16, causes the feed wheel shaft 18 and the feed wheel 20 to rotate. At the same time as the switch contacts 64 are being engaged and the motor 14 activated, depression of the lever 26 causes the lever pin 58 to ride along the slot 56 in the connector 44 until the pin engages the rear edge 88 thereof. Further movement of the lever 26 prompts the connector 44 to move to the left in FIG. 3. This connector motion causes the cutter control 46 to rotate in a counterclockwise direction (from the perspective of FIG. 3) and prompts the cutter 22, via the shaft 48, to move in a clockwise direction (from the perspective of FIG. 2) to a cutting position wherein the cutter 22 engages the can lid (FIG. 6*b*). As the cutter 22 is being rotated into a cutting position, the magnet arm 80 rides along the cam portion 84 of the plate 24 to lower the magnet 82 into contact with the can lid. When the motor 14 is activated, the feed wheel 20 is driven in a counterclockwise direction (from the perspective of FIG. 2), thereby causing the can to rotate in a counterclockwise direction (looking down at the top of the can) such that the cutter 22 is forced into the can lid (FIG. 6*c*). As discussed above, the cutter control 46 operates to maintain the switch contacts 64 in a closed position without the need for the user to continually depress the operating lever 26.

After the cutter 22 completely severs the can lid 92, the cutter control 46, as described above, operates to automatically shut off the motor 14. At this time, the cutter 22 and the linkage system 28 is in the position shown in FIG. 6*d*. Upward movement of the lever 26, as can be understood from the mechanics of the can opener 10 described above, removes the cutter 22 from the can 90 and causes the cam portion 84 of the plate 24 to raise the magnet assembly 78 and, thus, the severed can lid 92. At this point, the can 90 may be easily removed from the can opener 10 and the lid 92 can be safely removed from the magnet 82.

The following materials are suitable for use in the present invention: the can opener housing 12 may be formed of polystyrene supplied by Fina; the cutter control 46 may be formed of Acetal supplied by DuPont; and the cam-shaped plate 24 may be formed of zinc die-cast. Alternately, the housing 12, the cutter control 46 and the plate 24 may be formed of any material suitable for the application. The motor 14 is preferably a shaded-pole motor supplied by The Rival Company.

It should be appreciated that the can opener of the present invention, particularly the linkage system 28 and the cam-shaped plate 24, may be configured and shaped as appropriate for the application. The embodiment described above is to be considered in all respects only as illustrative and not restrictive. The scope of the invention is indicated by the following claims rather than by the foregoing description. All changes which come within the meaning and range of equivalency of the claims are to be embraced within their scope.

What is claimed is:

1. In a can opener of the type comprising a housing, a motor, a feed wheel for rotating a can about its axis, a gear assembly connecting the motor and the feed wheel, and a cutter for severing a can lid from a can, the improvement comprising:

a) a cutter control associatively connected to the cutter and operable to bias a switch contact to a closed position while the cutter is severing the can lid from the can and to automatically open the switch contact after the can lid has been severed, the cutter control comprising an integrally formed spring operable to engage an armature mounted on the housing;

b) a cutter support plate supporting the cutter and associatively connected to the cutter control, the cutter support plate operable to lower a magnet assembly into contact with the can lid when the cutter is moved into contact with the can lid and to raise the magnet assembly and the can lid when the cutter is raised from the can after the can lid has been severed from the can; and wherein the cutter support plate has a cam portion on which the magnet assembly rides, the cam portion of the cutter support plate operative to raise and to lower the magnet assembly.

2. The invention of claim 1 wherein the cutter control biases the switch contact through means of a lost-motion connector connected to the cutter control and an operating lever connected to the lost-motion connector, the operating lever operative to close and to open the switch contact.

3. The invention of claim 2 wherein the integrally formed spring of the cutter control comprises a spring arm and a biasing arm, the biasing arm operative to support the spring arm when the spring arm engages an armature attached to the housing of the can opener.

4. The invention of claim 2 wherein a force of approximately one pound is required to be applied to the operating lever to close the switch contact.

5. The invention of claim 1 wherein the cutter control is associatively connected to the cutter by a shaft.

6. The invention of claim 1 wherein the magnet assembly comprises a magnet lever arm pivotally mounted to the can opener and a magnet mounted on the end of the magnet lever arm.

7. The invention of claim 6 wherein the magnet lever arm is generally L-shaped.

8. A can opener comprising:

a) a cutter for severing a can lid from a can;

b) an operating lever for lowering and raising the cutter and for opening and closing a can opener switch contact;

c) a linkage system connecting the operating lever to the cutter, the linkage system comprising a cutter control having integrally formed spring and biasing arms operable to engage an armature mounted on a can opener housing, the cutter control operative to maintain the operating lever in a position where the switch contact is closed while the can lid is being severed from the can by the cutter and to maintain the operating lever in a position where the switch contact is open when the cutter has severed the can lid from the can; and wherein the cutter is mounted on a cutter support plate, the cutter support plate operative to lower a magnet assembly into contact with a can lid when the operating lever is lowered to move the cutter into contact with the can lid and to raise the magnet assembly and the can lid from the can when the operating lever is raised to remove the cutter from the can, the cutter support plate having a cam portion on which the magnet assembly rides, the cam portion operative to raise and to lower the magnet assembly.

9. The invention of claim 8 wherein the linkage system further comprises a lost-motion connector interconnecting the cutter control and the operating lever.

10. The invention of claim 8 wherein the biasing arm is operative to support the spring arm when the spring arm contacts the armature attached to the can opener housing.

11. The invention of claim 10 wherein a reactive force existing between the armature and the spring and biasing arms causes the cutter control to open the switch contact when the cutter has severed the can lid from the can.

12. The invention of claim 8 wherein the magnet assembly comprises a magnet lever arm pivotally mounted to the can opener and a magnet connected to the end of the magnet lever arm.

13. The invention of claim 12 wherein the magnet lever arm is generally L-shaped.

14. The invention of claim 8 wherein a force of approximately one pound is required to be applied to the operating lever to close the switch contact.

15. A can opener comprising:

a) a cutter mounted on a cutter support plate, and operative to sever a can lid from a can;

b) an operating lever associatively connected to the cutter support plate and operative to lower and raise the cutter and to open and close a can opener switch contact;

c) a magnet assembly pivotally mounted on the can opener and operatively associated with the cutter support plate, the cutter support plate operative to lower the magnet assembly into contact with the can lid when the operating lever is lowered to move the cutter into contact with the can lid and to raise the magnet assembly and the can lid when the operating lever is raised to remove the cutter from the can; and wherein the cutter support plate has a cam portion on which the magnet assembly rides.

16. The invention of claim 15 wherein the magnet assembly comprises a magnet lever arm pivotally mounted to the can opener and a magnet connected to the end of the magnet lever arm.

17. The invention of claim 16 wherein the magnet lever arm is generally L-shaped.

18. The invention of claim 15 wherein the operating lever is associatively connected to the cutter support plate by a linkage system comprising a cutter control having an integrally formed spring operative to maintain the operating lever in a position where the switch contact is closed while the can lid is being severed from the can by the cutter and to maintain the operating lever in a position where the switch contact is open when the cutter has severed the can lid from the can.

19. The invention of claim 18 wherein the linkage system further comprises a lost-motion connector interconnecting the cutter control and the operating lever.

20. The invention of claim 18 wherein the spring comprises a spring arm and a biasing arm, the biasing arm operative to support the spring arm when the spring arm contacts an armature attached to a can opener housing.

21. The invention of claim 15 wherein a force of approximately one pound is required to be applied to the operating lever to close the switch contact.

* * * * *